US008322101B2

(12) United States Patent
Kelly

(10) Patent No.: US 8,322,101 B2
(45) Date of Patent: Dec. 4, 2012

(54) ANCHORED ROOF SEAM AND METHOD FOR ANCHORING A SEAM TO A ROOF

(76) Inventor: Thomas L. Kelly, Waterbury, CT (US)

( * ) Notice: Subject to any disclaimer, the term of this patent is extended or adjusted under 35 U.S.C. 154(b) by 181 days.

(21) Appl. No.: 12/364,307

(22) Filed: Feb. 2, 2009

(65) Prior Publication Data

US 2010/0192497 A1 Aug. 5, 2010

(51) Int. Cl.
*E04D 5/00* (2006.01)

(52) U.S. Cl. ..... 52/409; 52/411; 52/412; 52/462; 52/466; 52/520

(58) Field of Classification Search ..... 52/23, 42, 52/408, 409, 411, 412, 462, 466, 515, 520, 52/540, 543
See application file for complete search history.

(56) References Cited

U.S. PATENT DOCUMENTS 4,718,211 A * 1/1988 Russell et al. ..... 52/409
4,855,172 A * 8/1989 Chiu ..... 428/57
5,319,908 A * 6/1994 Van Erden et al. ..... 52/410
7,594,369 B2 * 9/2009 Kelly ..... 52/302.3
* cited by examiner

*Primary Examiner* — William Gilbert
*Assistant Examiner* — Patrick Maestri

(74) *Attorney, Agent, or Firm* — Cantor Colburn LLP

(57) ABSTRACT

Disclosed is a roofing system including an anchored seam, the system including a roof deck, roof assembly components disposed upwardly adjacent of the roof deck, a first waterproofing membrane disposed upwardly adjacent of the roof assembly components, a second waterproofing membrane, a portion of which being disposed upwardly adjacent of the first waterproofing membrane, the portion of the second waterproofing membrane overlapping a portion of the first waterproofing to create a seam region between the first waterproofing membrane and the second waterproofing membrane, a termination bar including a convexity away from the roof deck disposed upwardly adjacent of the second waterproofing membrane in the seam region, and a mechanical fastener extending through the termination bar, the fastener being long enough to extend from the termination bar, wherein the mechanical fastener and the termination bar anchor the seam region to the roof deck.

11 Claims, 3 Drawing Sheets

ANCHORED ROOF SEAM AND METHOD FOR ANCHORING A SEAM TO A ROOF

FIELD

The disclosure is directed generally to a roof system including a membrane seam, and more particularly to a roof system including a membrane seam that is anchored to a roof.

BACKGROUND

Roof seam technology and construction is of particular importance in the roofing industry. This is because the seam or overlap between membranes (such as waterproofing membranes) can be an area of weakness or vulnerability to natural conditions such as wind uplift. Of course, such conditions can create a number of problems in a roofing system if a seam area were to fail.

In order to avoid such failure, roofers obviously try to provide seams that are as strongly associated as possible. One such current method for strengthening roof seams involves disposal of a fastened termination bar between the membranes in a overlap section of a roof. While such a method is helpful in that it strengthens the association between the roofing system and the lower membrane of the seam, disposal of a termination between the two lap/seam membranes does very little to strengthen the association of the upper membrane of the lap with the lower membrane of the lap and/or roofing system. Accordingly, a seam application/method that further strengthens the association of the upper membrane of the lap with the lower membrane of the lap and/or roofing system is desirable.

SUMMARY

Disclosed is a roofing system including an anchored seam, the system including a roof deck, roof assembly components disposed upwardly adjacent of the rood deck, a first waterproofing membrane disposed upwardly adjacent of the roof assembly components, a second waterproofing membrane, a portion of which being disposed upwardly adjacent of the first waterproofing membrane, the portion of the second waterproofing membrane overlapping a portion of the first waterproofing to create a seam region between the first waterproofing membrane and the second waterproofing membrane, a termination bar including a convexity away from the roof deck disposed upwardly adjacent of the second waterproofing membrane in the seam region, and a mechanical fastener extending through the termination bar, the mechanical fastener being long enough to extend from the termination bar, through the seam region and the roof assembly components, and into the roof deck, wherein the mechanical fastener and said termination bar anchor the seam region to the roof deck.

Also disclosed is a first waterproofing membrane disposed upwardly adjacent of the roof assembly components, a second waterproofing membrane, a portion of which being disposed upwardly adjacent of the first waterproofing membrane, the portion of the second waterproofing membrane overlapping a portion of the first waterproofing to create a seam region between the first waterproofing membrane and the second waterproofing membrane, a termination bar including a convexity away from the roof deck disposed upwardly adjacent of the second waterproofing membrane in the seam region, and a mechanical fastener extending through the termination bar, the mechanical fastener being long enough to extend from the termination bar, through the seam region and the roof assembly components, and into the roof deck, wherein the mechanical fastener and said termination bar anchor the seam region to the roof deck.

Further disclosed is a method for anchoring a roof seam, the method including providing a roof substrate that includes a roof deck and roof assembly components disposed upwardly adjacent of the rood deck, laying a first waterproofing membrane over the roof assembly components, laying a portion of a second waterproofing membrane over the roofing assembly components, laying an overlap portion of the second waterproofing membrane over an overlapped portion of the first waterproofing membrane, creating a seam region between the first waterproofing membrane the said second waterproofing membrane via the laying of the overlap portion over the overlapped portion, disposing a termination bar upwardly adjacent of the second waterproofing membrane in the seam region, the termination bar including a convexity away from the roof deck, and anchoring the first membrane to the second membrane, and anchoring the seam region to the roof deck, via a mechanical fastener extending through the termination bar, the mechanical fastener being long enough to extend from the termination bar, through the seam region and the roof assembly components, and into the roof deck.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION

Figure 1:
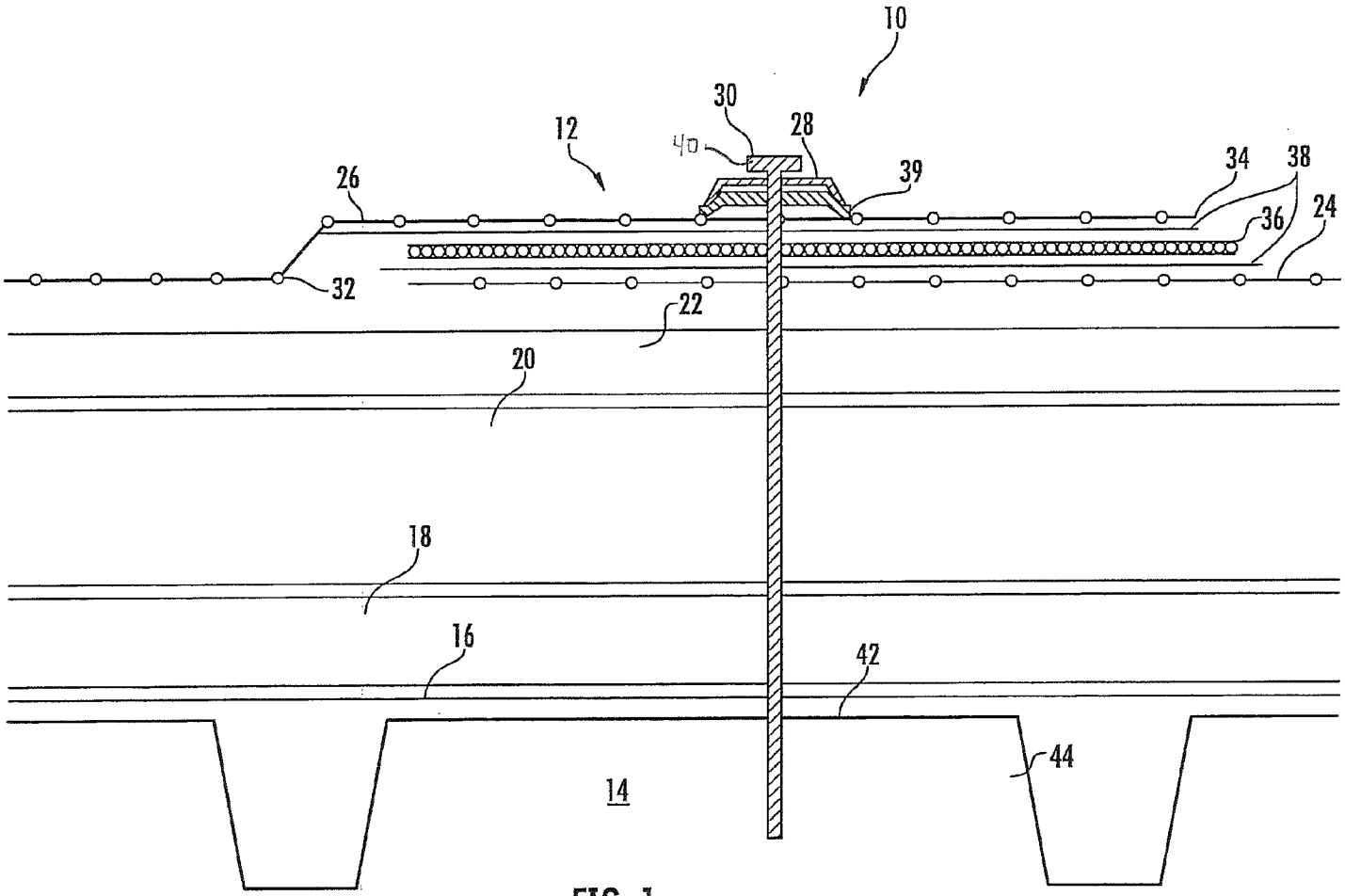
FIG. 1 is an elevated cross-sectional schematic of a roofing system with an anchored seam in accordance with an exemplary embodiment.

Referring to FIG. 1, a roofing system 10 including and anchored seam region 12 is illustrated. The system 10 includes a roof deck 14, and rigid roofing assembly components disposed upwardly adjacent of the roof deck 14, which is corrugated in this embodiment. In the exemplary embodiment of FIG. 1, the known in the art roofing assembly components consist of a vapor barrier 16 (or air retarder), fire barrier 18, insulation board 20, and coverboard 22. Disposed atop the coverboard 22 is a first waterproofing membrane 24 and second waterproofing membrane 26, which overlap at the seam region 12 and are laid (loose in an exemplary embodiment) over the coverboard 22. In this exemplary embodiment, these membranes 24 and 26 are reinforced EPDM waterproofing membranes.

The system 10 also includes termination or batten bar 28 (being of an aluminum material in an exemplary embodiment), and a mechanical fastener 30 (such as a roof screw). The batten bar 28 includes a convexity away from the roof deck 14 and membranes 24 and 26. The manner in which the first and second membranes 24 and 26 of the seam portion 12 overlap, as well as the manner in which the mechanical fastener 30 and batten bar 28 anchor the seam portion 12 to the roof deck 14, will be discussed in greater detail hereinbelow.

As is shown in FIG. 1, the seam portion 12 extends across an overlap of the first and second membranes 24 and 26. That is, the seam portion 12 extends from a point 32 where the second membrane 26 moves away from the coverboard 22 to overlap the first membrane 24, to a point 34 where the second membrane 26 terminates atop the first membrane 24. In the exemplary embodiment of FIG. 1, double-sided inseam tape 36 and primer 38 (such as "talc eater" primer) is disposed between the first and second membranes 24 and 26 at the seam region 12. As is also shown in the exemplary embodiment of FIG. 1, a sealant substrate 39 (such as butyl tape or caulk) is disposed between the batten bar 28 and an upper surface of the second membrane 26 within the seam portion 12.

Referring particularly to the seam portion 12 of FIG. 1, the mechanical fastener 30 is illustrated to compress the batten bar 28, and sealant substrate 39 disposed thereunder, over a portion of the top surface of the second membrane 26. As is shown in the Figure, the mechanical fastener 30 is long enough to extend from an exposed fastener head 40 (disposed upwardly of the batten bar 28) to the roof deck 14. By penetrating to and into the roof deck 14 (or some other similarly permanent and rigid roof component), the mechanical fastener 30 compresses the batten bar 28 over the second membrane 26, thereby anchoring the seam portion 12 to the deck 14 and or roof in general. In the exemplary embodiment shown in FIG. 1, this penetration into the roof deck 14 occurs at an upper rib surface 42 of the corrugations 44. Disposal of the batten bar 28 above the second membrane 26 in this manner provides a strong association between the first and second membranes 24 and 26, as well as the first and second membranes 24 and 26 and the roof deck 14 (and the rest of the roofing system).

Figure 2:
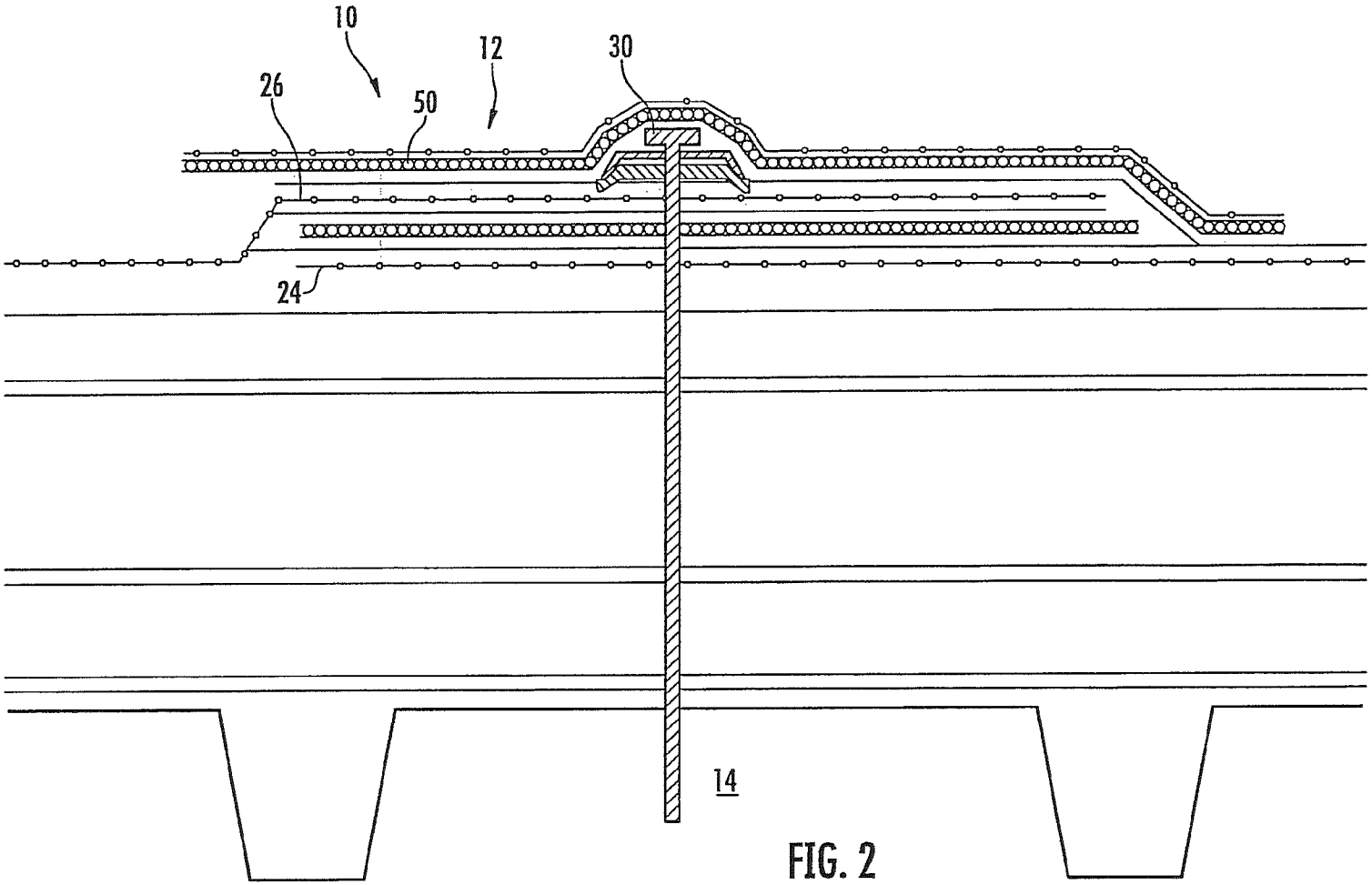
FIG. 2 is an elevated cross-sectional schematic of the roofing system of FIG. 1 with a covered anchored seam.

Referring now to FIG. 2, the roofing system 10 of FIG. 1 is illustrated to include a cover portion 50 for the seam region 12. The cover portion 50 extends beyond the extents of the seam region 12 (i.e. beyond the points 32 and 34), such that (if viewing the Figure from left to right) the cover portion 50 covers at least a portion of the second membrane 24 disposed relatively "before" the overlap, and at least a portion of the first membrane 24 disposed relatively "after" the overlap. In the exemplary embodiment of FIG. 2, the cover portion 50 consists of 9 inch EPDM with butyl tape pre-applied, and serves to cover and further waterproof the head 40 of the mechanical fastener 30.

Figure 3:
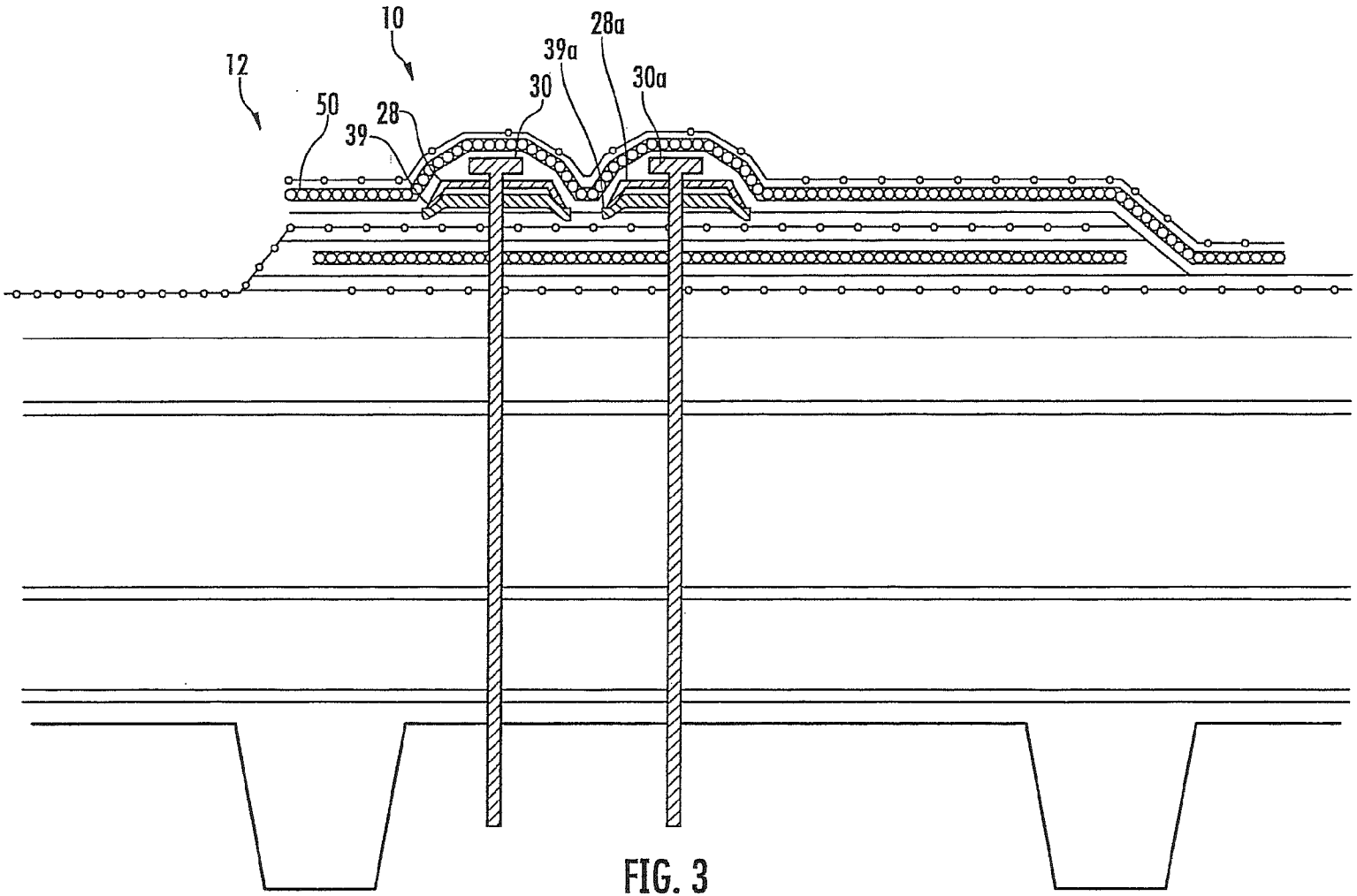
FIG. 3 is an elevated cross-sectional schematic of the roofing system of FIG. 2 with a second fastener.

Referring now to FIG. 3, the system 10 of FIG. 1, including the cover portion 50 of FIG. 2, is illustrated to include a second batten bar 28*a*, sealant substrate 39*a*, and mechanical fastener 30*a*. In this embodiment, the like numbered components are the same as those shown in FIGS. 1 and 2. The only difference is an addition of the second batten bar 28*a*, sealant substrate 39*a*, and mechanical fastener 30*a*, which are each substantially identical their respective counterparts; batten bar 28, sealant substrate 39, and mechanical fastener 30. The addition of this second set of anchoring components strengthens the association between the seam region 12 and roof deck 14.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A method for anchoring a roof seam, the method comprising:

providing a roof substrate that includes a corrugated roof deck and roof assembly components disposed upwardly adjacent of said rood deck;

laying a first waterproofing membrane over said roof assembly components;

laying a portion of a second waterproofing membrane over said roofing assembly components, laying an overlap portion of said second waterproofing membrane over an overlapped portion of said first waterproofing membrane;

creating a seam region between said first waterproofing membrane and said second waterproofing membrane via said laying of said overlap portion over said overlapped portion;

laying a sealing substrate over said overlap portion of said second waterproofing membrane disposing a metal termination bar upwardly adjacent of said sealing substrate in said seam region, said termination bar including metal legs extending obliquely from a central portion towards said roof deck, and said metal legs defining a bar cavity including a greater width than a combined width of said legs;

positioning said termination bar being directly over an upwardly extending corrugation of said corrugated roof deck and anchoring said first membrane to said second membrane, and anchoring said seam region to said roof deck, via a mechanical fastener extending through said termination bar, said mechanical fastener being long enough to extend from said termination bar, through said seam region and said roof assembly components, and into said upwardly extending corrugation of said corrugated roof deck, and said mechanical fastener compressing said metal termination bar and sealant substrate such that said sealant substrate is deformed in a direction of said second membrane at areas of contact between said metal legs of said metal termination bar and said sealant substrate, and a remaining non-deformed portion of said sealant substrate nests within said bar cavity, said non-deformed portion of said sealant structure including a greater width than a combined width of said areas of contact that are deformed.

2. A roofing system including an anchored seam, the system comprising:

a corrugated roof deck;

roof assembly components disposed upwardly adjacent of said roof deck;

a first waterproofing membrane disposed upwardly adjacent of said roof assembly components;

a second waterproofing membrane, a portion of which being disposed upwardly adjacent of said first waterproofing membrane, said portion of said second waterproofing membrane overlapping a portion of said first waterproofing membrane to create a seam region between said first waterproofing membrane and said second waterproofing membrane;

a metal termination bar including metal legs extending obliquely from a central portion towards said roof deck, said metal legs defining a bar cavity including a greater width than a combined width of said legs, said metal termination bar being disposed upwardly adjacent of a sealant substrate disposed upwardly adjacent of said second waterproofing membrane in said seam region, said termination bar being positioned directly over an upwardly extending corrugation of said corrugated roof deck; and a mechanical fastener extending through said termination bar, said mechanical fastener being long enough to extend from said termination bar, through said seam region and said roof assembly components, and into said upwardly extending corrugation of said corrugated roof deck, wherein said mechanical fastener and said termination bar anchor said seam region to said roof deck seam, and wherein said mechanical fastener compresses said metal termination bar and sealant substrate such that said sealant substrate is deformed in a direction of said second membrane at areas of contact between said metal legs of said metal termination bar and said sealant substrate, and a remaining non-deformed portion of said sealant substrate nests within said bar cavity, said non-deformed portion of said sealant structure including a greater width than a combined width of said areas of contact that are deformed.

3. The system of claim 2, wherein said termination bar is a batten bar.

4. The system of claim 2, wherein said roof assembly components include a vapor barrier disposed upwardly adjacent of said roof deck, a fire barrier disposed upwardly adjacent of said vapor barrier, and insulation board disposed upwardly adjacent of said fire barrier, and a coverboard disposed upwardly adjacent of said insulation board, said first waterproofing membrane being disposed upwardly adjacent of said coverboard.

5. The system of claim 1, wherein a layer of double-sided seam tape is disposed between said first waterproofing membrane and said second waterproofing membrane at said seam region.

6. The system of claim 2, wherein a layer of cover tape is disposed upwardly adjacent of an exposed portion of said mechanical fastener, said cover tape extending across said seam region such that said double-sided seam tape covers a portion of said second waterproofing membrane disposed outside of the seam region, and a portion of said first waterproofing membrane disposed outside said seam region.

7. The system of claim 2, further including a second termination bar and a second mechanical fastener disposed in said seam region.

8. An anchored roof seam for a corrugated roof, said anchored roof seam comprising:

a first waterproofing membrane;

a second waterproofing membrane, a portion of which being disposed upwardly adjacent of said first waterproofing membrane, said portion of said second waterproofing membrane overlapping a portion of said first waterproofing to create a seam region between said first waterproofing membrane and said second waterproofing membrane;

a metal termination bar including metal legs extending obliquely from a central portion towards said second waterproofing membrane, said metal legs defining a bar cavity including a greater width than a combined width of said legs, said metal termination bar being disposed upwardly adjacent of a sealant substrate disposed upwardly adjacent of said second waterproofing membrane in said seam region, said termination bar being positioned directly over an upwardly extending corrugation of said corrugated roof deck; and a mechanical fastener extending through said termination bar and said seam region, wherein said mechanical fastener and said termination bar are configured to anchor said seam region to the upwardly extending corrugation of the corrugated roof, and wherein said mechanical fastener compresses said metal termination bar and sealant substrate such that said sealant substrate is deformed in a direction of said second membrane at areas of contact between said metal legs of said metal termination bar and said sealant substrate, and a remaining non-deformed portion of said sealant substrate nests within said bar cavity, said non-deformed portion of said sealant structure including a greater width than a combined width of said areas of contact that are deformed.

9. The roof seam of claim 8, wherein said termination bar is a batton bar.

10. The roof seam of claim 8, wherein a layer of double-sided seam tape is disposed between said first waterproofing membrane and said second waterproofing membrane at said seam region.

11. The roof seam of claim 8, wherein a layer of cover tape is disposed upwardly adjacent of an exposed portion of said mechanical fastener, said cover tape extending across said seam region such that said double-sided seam tape covers a portion of said second waterproofing membrane disposed outside of the seam region, and a portion of said first waterproofing membrane disposed outside said seam region.

* * * * *